US010925360B1

(12) United States Patent
Schwiebert

(10) Patent No.: US 10,925,360 B1
(45) Date of Patent: Feb. 23, 2021

(54) PORTABLE, ERGONOMIC, AND SELECTIVELY ADJUSTABLE UMBRELLA AND SEAT SUPPORT STRUCTURE

(71) Applicant: Mike Schwiebert, Green Cove Springs, FL (US)

(72) Inventor: Mike Schwiebert, Green Cove Springs, FL (US)

( * ) Notice: Subject to any disclaimer, the term of this patent is extended or adjusted under 35 U.S.C. 154(b) by 0 days.

(21) Appl. No.: 16/656,634

(22) Filed: Oct. 18, 2019

(51) Int. Cl.

| | |
|---|---|
| ***A47C 9/00*** | (2006.01) |
| ***A47C 7/66*** | (2006.01) |
| ***A45B 17/00*** | (2006.01) |
| ***A45B 25/02*** | (2006.01) |
| ***E04H 4/14*** | (2006.01) |
| ***E04H 12/22*** | (2006.01) |
| *A45B 23/00* | (2006.01) |
| *A45B 25/00* | (2006.01) |

(52) U.S. Cl.
CPC ..... *A45B 17/00* (2013.01); *A45B 25/02* (2013.01); *A47C 7/664* (2018.08); *A47C 9/00* (2013.01); *E04H 4/14* (2013.01); *E04H 12/2246* (2013.01); *A45B 2023/0006* (2013.01); *A45B 2023/0012* (2013.01); *A45B 2025/003* (2013.01); *A45B 2200/1054* (2013.01)

(58) Field of Classification Search
CPC ..... E04H 12/22; E04H 12/2246; A45B 2023/0006; A45B 2023/0012; A45B 2200/1054; A45B 2025/003; A45B 17/00; A47C 7/664; A47C 7/50
USPC ..... 135/15.1, 16, 20.1; 4/496; 297/184.16, 297/423.38, 423.1; 248/910; 108/50.12
See application file for complete search history.

(56) References Cited

U.S. PATENT DOCUMENTS

| | | | | | |
|---|---|---|---|---|---|
| 969,347 | A * | 9/1910 | Davis | A47C 3/18 | 297/311 |
| 2,038,806 | A * | 4/1936 | Sellar | A47C 9/025 | 248/398 |
| 2,190,222 | A * | 2/1940 | Strasser | A47B 37/04 | 248/158 |
| 2,323,473 | A * | 7/1943 | Korling | F16M 11/10 | 248/183.2 |

(Continued)

FOREIGN PATENT DOCUMENTS

| | | | | |
|---|---|---|---|---|
| CA | 1231695 A * | 1/1988 | | E04H 12/2246 |
| CA | 1231695 A1 * | 1/1988 | | |

(Continued)

*Primary Examiner* — Robert Canfield
(74) *Attorney, Agent, or Firm* — Ashkan Najafi

(57) ABSTRACT

A support structure including an umbrella having an extension pole, and a base capable of being positioned on a bottom surface of a pool wherein the base has a through-hole. An umbrella base connector is seated within the through-hole. An articulating mechanism is adjustably coupled to the at least one extension pole of the umbrella and to the umbrella base connector, a first connector has a top end attached to the extension pole of the umbrella, and further has a first adjustable portion opposed from the top end. A second connector has a bottom end attached to the umbrella base connector, and further has a second adjustable portion opposed from the bottom end. The first adjustable portion is rotatably affixed to the second adjustable portion such that the umbrella and the extension pole of the umbrella are articulated relative to a stationary position of the base.

11 Claims, 9 Drawing Sheets

(56) References Cited

U.S. PATENT DOCUMENTS 2,462,560 A * 2/1949 Schmidt ..... A45B 17/00 135/74
2,799,543 A * 7/1957 Tomaselli ..... A45B 23/00 108/50.12
2,805,109 A * 9/1957 Kopmar ..... A45B 23/00 108/25
3,038,688 A * 6/1962 Thorburn ..... A47G 33/12 47/40.5
3,167,292 A * 1/1965 Meyerowitz ..... A47C 3/28 248/230.1
3,419,295 A * 12/1968 Small ..... A45B 17/00 403/92
3,434,484 A * 3/1969 Dilullo ..... A45B 17/00 135/16
3,489,157 A * 1/1970 Pearlstine ..... A45B 17/00 135/20.3
3,624,732 A * 11/1971 Bowden ..... A45B 3/00 108/50.12
4,023,582 A * 5/1977 Buzzella ..... A45B 11/00 135/15.1
4,148,524 A * 4/1979 Guyton ..... A47C 7/506 248/188.5
4,548,446 A * 10/1985 Warshawsky ..... F21V 21/26 285/185
4,591,126 A * 5/1986 Berney ..... E04H 12/2246 248/524
4,596,262 A * 6/1986 Tegze ..... E04H 12/2246 135/21
4,724,773 A * 2/1988 Newberry ..... A47B 91/08 108/150
4,776,046 A * 10/1988 Newberry ..... A47B 91/08 4/541.6
4,877,045 A * 10/1989 Lin ..... A45B 17/00 135/20.3
4,878,509 A * 11/1989 Tung ..... A45B 17/00 135/20.3
4,920,897 A * 5/1990 Reed ..... A47B 37/04 108/150
5,100,091 A * 3/1992 Pollak ..... A61G 5/10 248/278.1
5,197,394 A * 3/1993 Schmidt ..... A45B 23/00 108/128
5,265,969 A * 11/1993 Chuang ..... A45B 17/00 16/329
5,273,062 A * 12/1993 Mozdzanowski ..... A45B 3/00 135/16
5,354,031 A * 10/1994 Bilotti ..... E04H 12/2238 248/511
5,465,677 A * 11/1995 Alter ..... B63B 21/50 114/230.1
5,572,750 A * 11/1996 Johnston ..... E04H 4/14 4/494
5,711,331 A * 1/1998 Harris ..... A45B 9/00 135/16
5,823,121 A * 10/1998 Reiter ..... A47B 37/00 108/147.19
6,467,843 B1 * 10/2002 Rossborough ..... A47C 3/34 108/150
6,571,403 B2 * 6/2003 Wheaton ..... E04H 4/14 4/496
7,784,761 B2 * 8/2010 Ma ..... E04H 12/2246 248/523
8,506,010 B2 * 8/2013 Kane ..... A47B 37/04 297/158.3
8,544,943 B2 * 10/2013 Fields ..... A47C 1/11 297/188.01
8,998,319 B2 * 4/2015 Bahneman ..... A47C 9/00 297/195.11
9,192,214 B2 * 11/2015 Gambill ..... A45B 23/00
9,310,021 B2 * 4/2016 Hennessey ..... F16M 11/10
9,578,973 B1 * 2/2017 Kalista ..... B63C 9/30
2003/0070698 A1 * 4/2003 Wells ..... A45F 3/44 135/20.1
2004/0129184 A1 * 7/2004 Kraker ..... A47G 23/0225 108/50.12
2005/0017148 A1 * 1/2005 Tung ..... E04H 12/2269 248/346.01
2005/0189005 A1 * 9/2005 Smith ..... G09F 23/00 135/16
2006/0124157 A1 * 6/2006 Bayour ..... A45B 23/00 135/16
2006/0232109 A1 * 10/2006 Olano ..... A47C 3/04 297/195.11
2007/0133191 A1 * 6/2007 Ma ..... F21V 33/006 362/102
2007/0236060 A1 * 10/2007 Switzer ..... A47C 15/006 297/240
2007/0246091 A1 * 10/2007 Becker ..... A47B 37/04 135/16
2009/0189035 A1 * 7/2009 Gambill ..... A45B 23/00 248/218.4
2011/0185491 A1 * 8/2011 Roberts ..... B23P 17/04 4/496
2011/0278248 A1 * 11/2011 Pron ..... A45B 3/00 211/107
2011/0297196 A1 * 12/2011 Durante ..... A45B 17/00 135/15.1
2012/0054954 A1 * 3/2012 Vandiver ..... A47C 3/24 4/496
2012/0124733 A1 * 5/2012 Roberts ..... A47C 15/004 4/496
2013/0034380 A1 * 2/2013 Cutsforth ..... F16M 11/10 403/110
2013/0341988 A1 * 12/2013 Walker ..... A47C 9/007 297/423.17
2016/0015137 A1 * 1/2016 Sasaki ..... A45B 25/00 135/20.1
2016/0106187 A1 * 4/2016 Sloan ..... A45B 23/00 135/16
2019/0059596 A1 * 2/2019 Wallace ..... A47C 7/029

FOREIGN PATENT DOCUMENTS

CH 255273 A * 6/1948 ..... A45B 17/00
DE 3036340 A1 * 6/1982 ..... A45B 23/00
DE 3337379 A1 * 4/1985 ..... E04H 12/2246
DE 20317530 U1 * 4/2004 ..... A45B 25/00
EP 0079865 A1 * 5/1983 ..... E04H 12/2246
EP 0306542 A1 * 3/1989 ..... A45B 23/00
EP 0822305 A1 * 2/1998 ..... E04H 12/2246
GB 450919 A * 7/1936 ..... A45B 17/00
GB 2355925 A * 5/2001 ..... A01G 9/124

* cited by examiner

PORTABLE, ERGONOMIC, AND SELECTIVELY ADJUSTABLE UMBRELLA AND SEAT SUPPORT STRUCTURE

BACKGROUND

Technical Field

Exemplary embodiment(s) of the present disclosure relate to umbrella canopies and, more particularly, to a portable, ergonomic, and selectively adjustable umbrella support structure and associated seat for providing user enjoyment in a pool environment.

Prior Art

There are a wide variety of pool accessories that are known in the art. Some of these are buoyant devices that allow a user to sit or sleep thereon, all the while enjoying the environment of the pool. Spending time in a pool one of the most enjoyable activities during a hot summer day. Similarly, enjoying one's favorite beverage is another method to beat the heat of the hot summer days. It is, however, inconvenient for a user to consume a beverage while being in the pool, even if the user is using the conventionally known buoyant devices, commonly referred to as floats. This is because the user has to constantly hold on to the beverage container, while taking care that the beverage does not spill into the water or the water of the pool does not accidentally enter the beverage container. It is also desired that the user may enjoy their favorite beverage in the pool environment while also being protected from the harmful sunrays.

Accordingly, a need remains for a portable, ergonomic, and selectively adjustable umbrella support structure and associated seat in order to overcome at least one aforementioned shortcoming. The exemplary embodiment(s) satisfy such a need by providing a portable, ergonomic, and selectively adjustable umbrella support structure and associated seat that is convenient and easy to use, lightweight yet durable in design, versatile in its applications, and designed for providing user enjoyment in a pool environment.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a support structure for providing user enjoyment within a pool. These and other objects, features, and advantages of the non-limiting exemplary embodiment(s) are provided by a support structure including an umbrella having at least one extension pole provided with a centrally registered longitudinal axis, and a base capable of being positioned on a bottom surface of a pool wherein the base has a substantially central through-hole axially aligned with the centrally registered longitudinal axis. An umbrella base connector is seated within the through-hole and extended vertically upward from the base along the centrally registered longitudinal axis. An articulating mechanism is adjustably coupled to the at least one extension pole of the umbrella and to the umbrella base connector. Such an articulating mechanism includes a first connector having a hollow tubular top end attached to the at least one extension pole of the umbrella, and further has a first adjustable portion opposed from the hollow tubular top end. A second connector has a hollow tubular bottom end attached to the umbrella base connector, and further has a second adjustable portion opposed from the hollow tubular bottom end. Advantageously, the first adjustable portion is rotatably affixed to the second adjustable portion such that the umbrella and the at least one extension pole of the umbrella are selectively articulated relative to a stationary position of the base and about a fulcrum axis registered orthogonal to the centrally registered longitudinal axis. Such a structural configuration provides the new, useful, and unexpected result of facilitating user enjoyment while drinking beverages in a pool environment.

In a non-limiting exemplary embodiment, the articulating mechanism includes a washer intermediately seated between the first adjustable portion and the second adjustable portion. A first fastener is passed through the first adjustable portion, the second adjustable portion, and the washer. A knob is in threaded engagement with the fastener for selectively adjusting a tilt angle of the first adjustable portion relative to the second adjustable portion. Such a structural configuration provides the new, useful, and unexpected result of facilitating controlled articulation of the umbrella with respect to the umbrella base connector and the base.

In a non-limiting exemplary embodiment, the at least one extension pole includes a first pole and a second pole in a telescopic engagement with the first pole, and a second fastener configured to selectively lock the first pole to the second pole. Such a structural configuration provides the new, useful, and unexpected result of varying the height of the umbrella depending upon the heights of the users. For example, the height may be set to minimum for children, and the height may be set at maximum for adults.

In a non-limiting exemplary embodiment, the support structure further includes a third fastener, and a cup holder tray linearly reciprocated along at least one of the first pole and the second pole and secured thereto via the third fastener. Advantageously, the cup holder is displaced along the centrally registered longitudinal axis and remains positioned above the base. Such a structural configuration provides the new, useful, and unexpected result of selectively securing the cup holder to the first or the second pole depending on the height of the users as well as the depth of the water in the pool, thereby ensuring that a beverage container is held within the cup holder tray above the water surface.

In a non-limiting exemplary embodiment, the base has a hollow configuration and an opening in fluid communication therewith for receiving and housing a ballast material therein. Such a structural configuration provides the new, useful, and unexpected result of providing an optimal weight to the base that is required for underwater stability.

In a non-limiting exemplary embodiment, the support structure further includes a plurality of umbrella gripper pads attached to and juxtaposed at a bottom surface of the base. Advantageously, at least one umbrella gripper pad from the plurality of umbrella gripper pads has a first protrusion extended upwardly through the opening along the centrally registered longitudinal axis. In this manner, the first protrusion being detachably connected to the umbrella base connector. Such a structural configuration provides the new, useful, and unexpected result of facilitating a secure placement of the support structure underwater.

In a non-limiting exemplary embodiment, the structure further includes a seat for receiving a user buttock thereon. Such a seat is located adjacent to the umbrella and includes a seat base capable of being positioned on a bottom surface of a pool. The seat base has an axial bore. A seat base connector is linearly inserted within the axial bore, and an anchor pole is attached to the seat base connector. Notably, the anchor pole has a telescopic configuration. A leg rest is also provided. A three-way coupling is attached to the anchor pole and the leg rest to facilitate linear reciprocation of the leg rest with respect to the anchor pole. A seat cushion is fitted at a top end of the anchor pole. Such a structural configuration provides the new, useful, and unexpected result of providing the user with an option to support their buttocks on a seat while enjoying in the pool.

In a non-limiting exemplary embodiment, the seat base has a hollow configuration and an opening for receiving in a ballast material therein. Such a structural configuration provides the new, useful, and unexpected result of providing an optimal weight to the seat base that is required for underwater stability.

In a non-limiting exemplary embodiment, the support structure further includes a plurality of seat base gripper pads attached to and juxtaposed at a bottom surface of the seat base. Advantageously, at least one seat base gripper pad has a second protrusion connected with the seat base connector. Such a structural configuration provides the new, useful, and unexpected result of facilitating a secure placement of the seat structure underwater.

In a non-limiting exemplary embodiment, a pair of diametrically opposed slots are located within the axial bore. Advantageously, the seat base connector has a pair of diametrically opposed fingers statically affixed thereto. Such fingers are linearly and slidably inserted into the opposed slots for receiving and locking the seat base connector to the seat base. Such a structural configuration provides the new, useful, and unexpected result of locking the movement the seat base connector and the anchor pole underwater.

In a non-limiting exemplary embodiment, the three-way coupling is directly affixed to the leg rest and the anchor pole. Such a structural configuration provides the new, useful, and unexpected result of facilitating the variation in the height of the leg rest depending the height of the user seated on the seat.

The present disclosure further includes a support structure for providing user enjoyment within a pool, the support structure including: a portable umbrella having at least one extension pole provided with a centrally registered longitudinal axis; a portable base capable of being positioned on a bottom surface of a pool, the base having a substantially central through-hole axially aligned with the centrally registered longitudinal axis; an umbrella base connector seated within the through-hole and extended vertically upward from the base along the centrally registered longitudinal axis; an articulating mechanism adjustably coupled to the at least one extension pole of the umbrella and to the umbrella base connector, the articulating mechanism including a first connector having a hollow tubular top end attached to the at least one extension pole of the umbrella, and further having a first adjustable portion opposed from the hollow tubular top end, and a second connector having a hollow tubular bottom end attached to the umbrella base connector, and further having a second adjustable portion opposed from the hollow tubular bottom end; wherein the first adjustable portion is rotatably affixed to the second adjustable portion such that the umbrella and the at least one extension pole of the umbrella are selectively articulated relative to a stationary position of the base and about a fulcrum axis registered orthogonal to the centrally registered longitudinal axis. Such a structural configuration provides the new, useful, and unexpected result of facilitating user enjoyment while drinking beverages in a pool environment.

The present disclosure further includes a method of utilizing a support structure for providing user enjoyment within a pool. Such a method includes the steps of: accessing a pool; providing a portable umbrella having at least one extension pole provided with a centrally registered longitudinal axis; providing and positioning a portable base on a bottom surface of the pool, the base having a substantially central through-hole axially aligned with the centrally registered longitudinal axis; providing and seating an umbrella base connector within the through-hole and extending the umbrella base connector vertically upward from the base along the centrally registered longitudinal axis; and providing and adjustably coupling an articulating mechanism to the at least one extension pole of the umbrella and to the umbrella base connector. Such an articulating mechanism includes a first connector having a hollow tubular top end attached to the at least one extension pole of the umbrella, and further having a first adjustable portion opposed from the hollow tubular top end. The articulating mechanism further includes a second connector having a hollow tubular bottom end attached to the umbrella base connector, and further having a second adjustable portion opposed from the hollow tubular bottom end. Such a combination of method steps provide the new, useful, and unexpected result of allowing the user to consume their favorite beverage while also enjoying in the pool.

The method further includes the step of: rotatably affixing the first adjustable portion to the second adjustable portion such that the umbrella and the at least one extension pole of the umbrella are selectively articulated relative to a stationary position of the base and about a fulcrum axis registered orthogonal to the centrally registered longitudinal axis. Such a combination of method steps provide the new, useful, and unexpected result of facilitating controlled articulation of the umbrella with respect to the umbrella base connector and the base.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
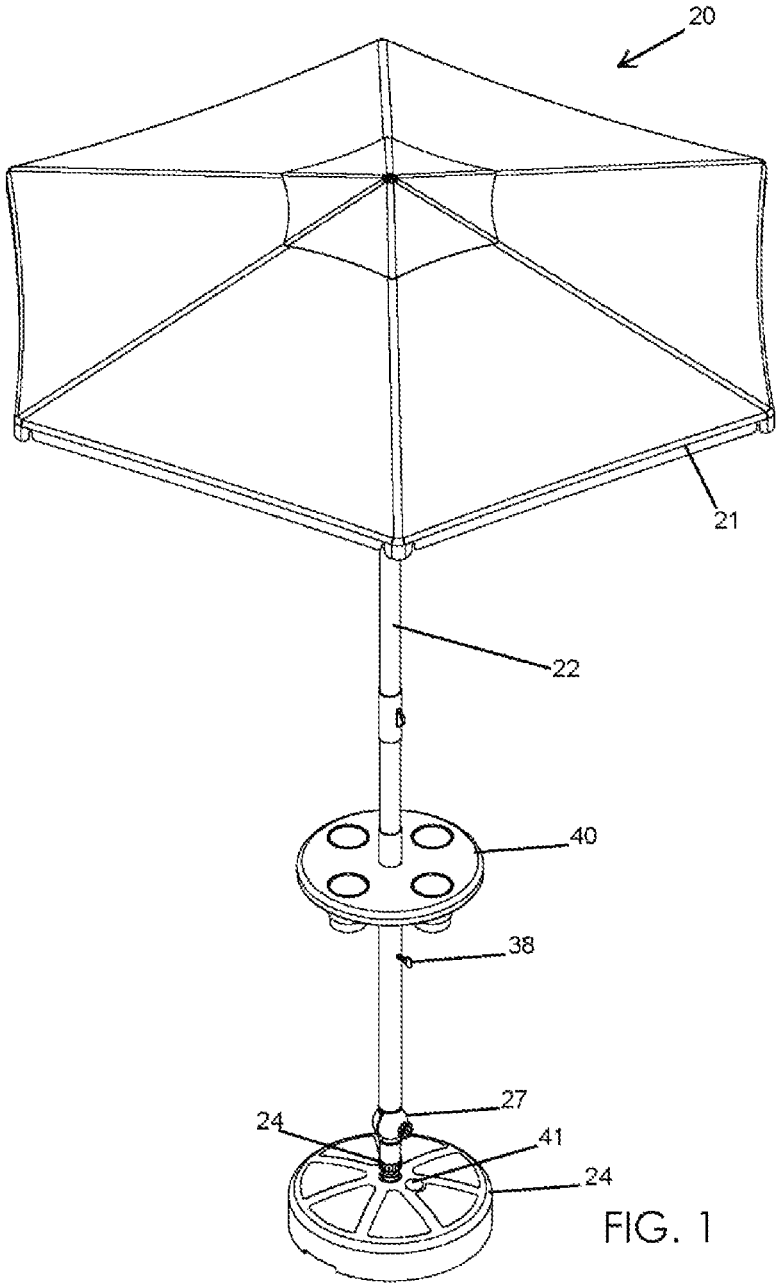
FIG. 1 is a perspective view of a selectively adjustable umbrella support structure for providing user enjoyment within a pool, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

Figure 2:
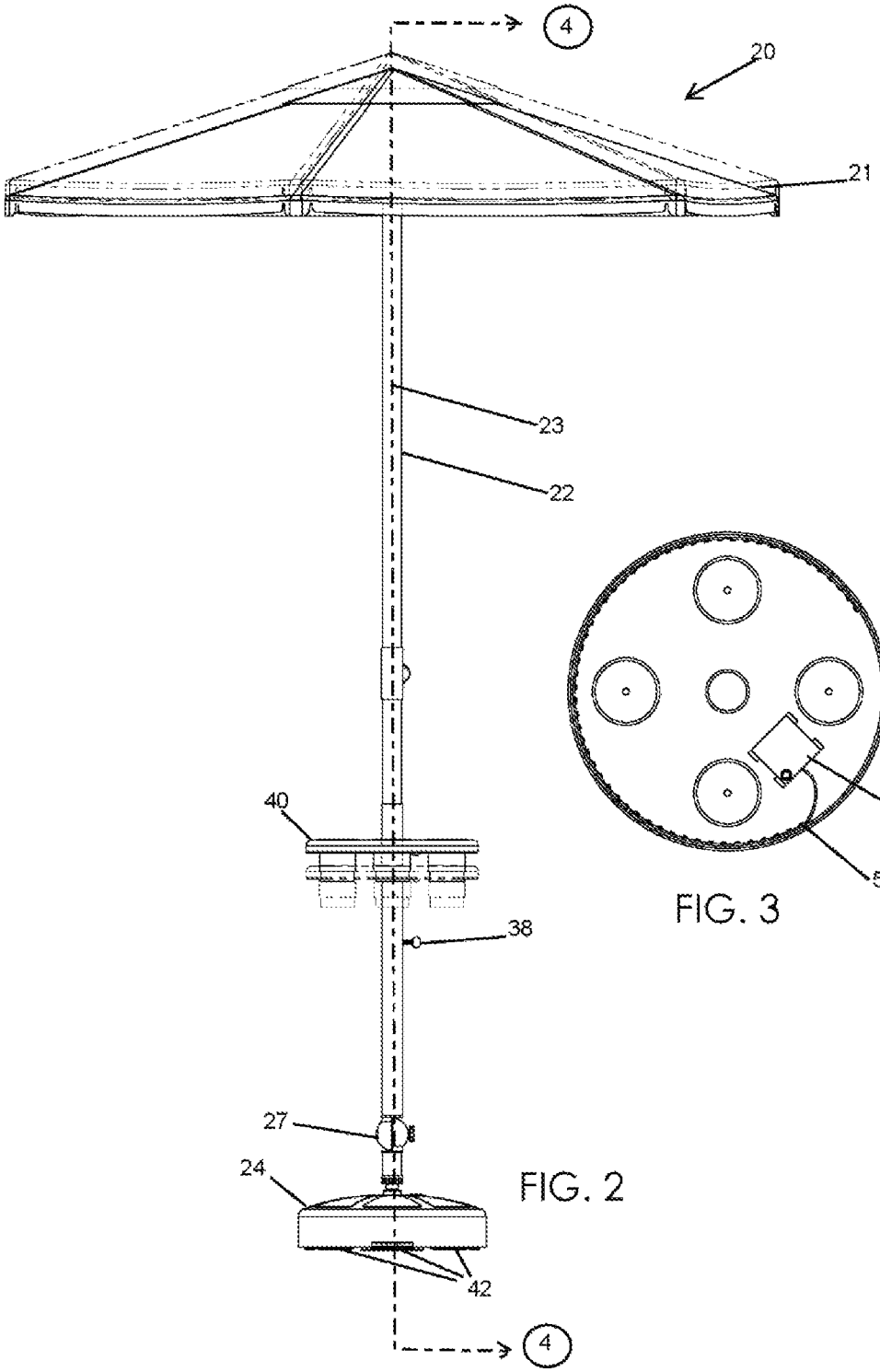
FIG. 2 is a side elevational view of the support structure shown in FIG. 1 wherein the umbrella canopy and cup shoulder are vertically reciprocated.
Figure 3:
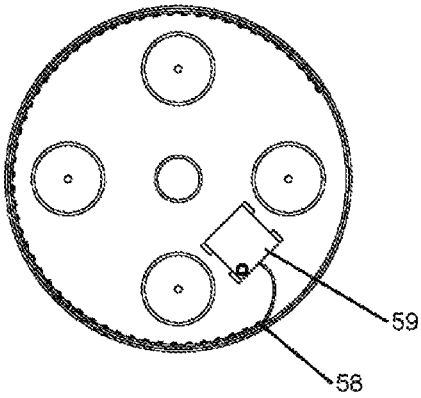
FIG. 3 is a bottom plan view of the cup holder showing LEDs and an associated controller attached thereto.
Figure 4A:
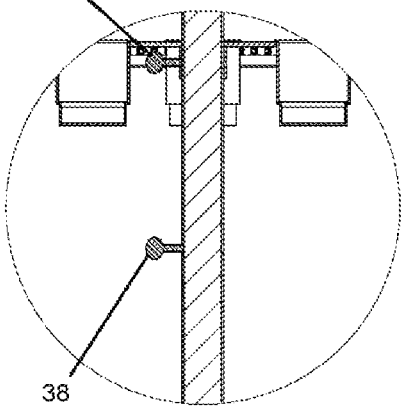
FIG. 4A is an enlarged view of section 4A taken in FIG. 4.
Figure 4:
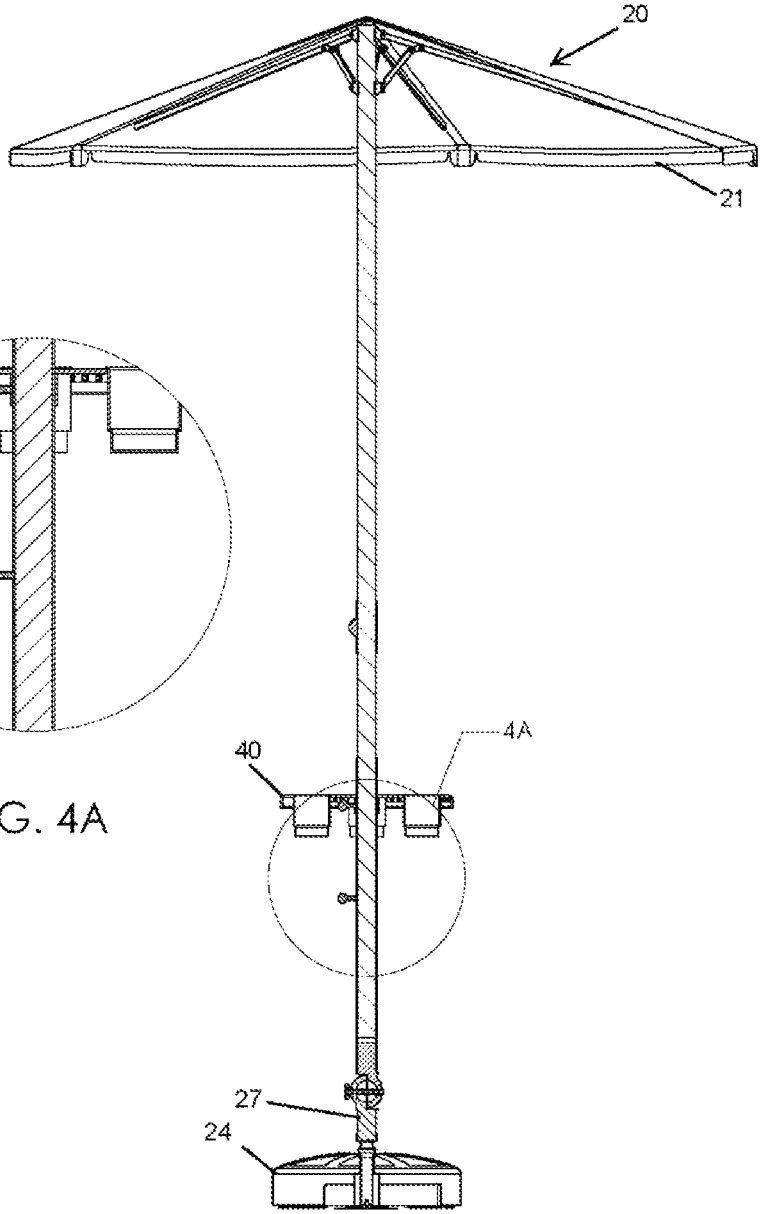
FIG. 4 is a cross-sectional view taken along line 4-4 in FIG. 3.
Figure 5:
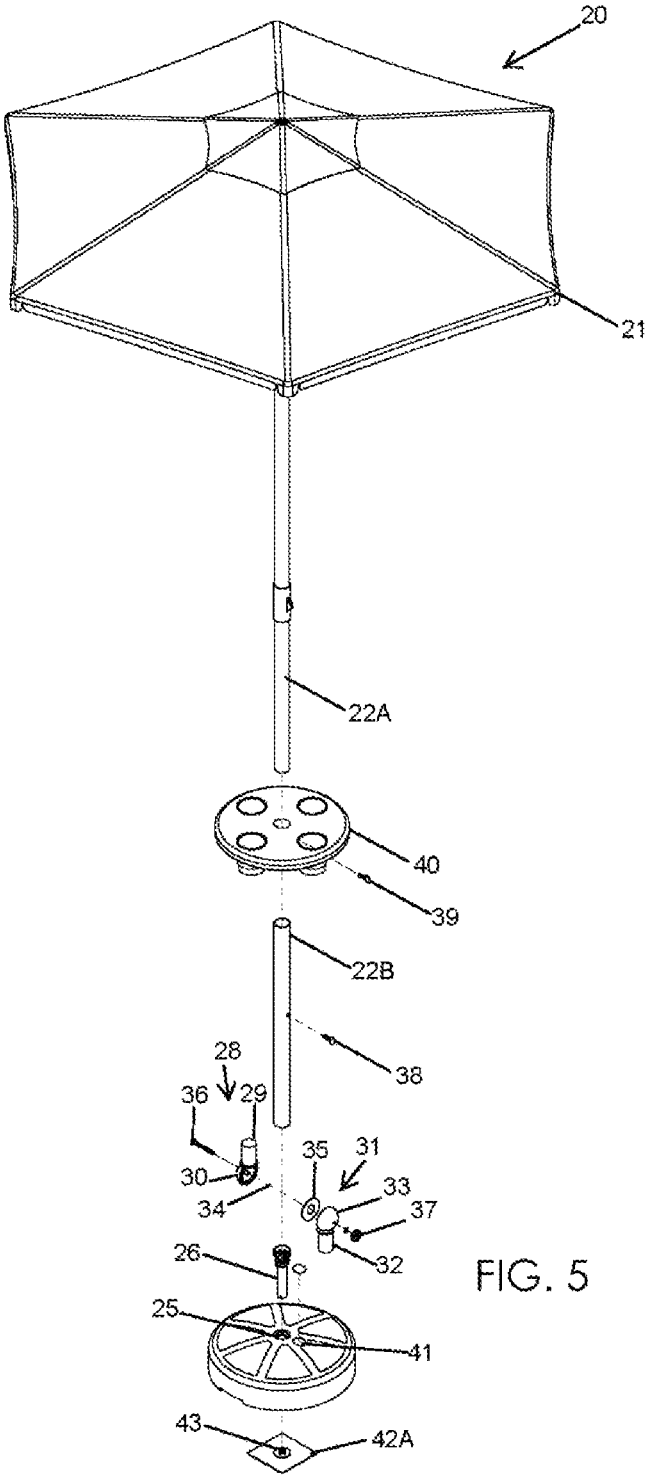
FIG. 5 is an exploded view of the support structure shown in FIG. 1.
Figure 6:
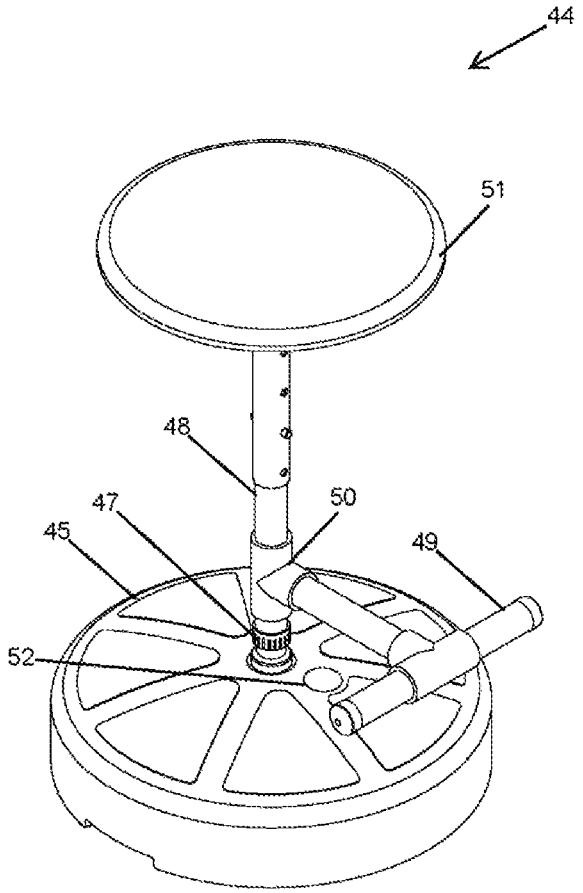
FIG. 6 is a perspective view of a seat selectively disposed adjacent to the support structure shown in FIG. 1.
Figure 7:
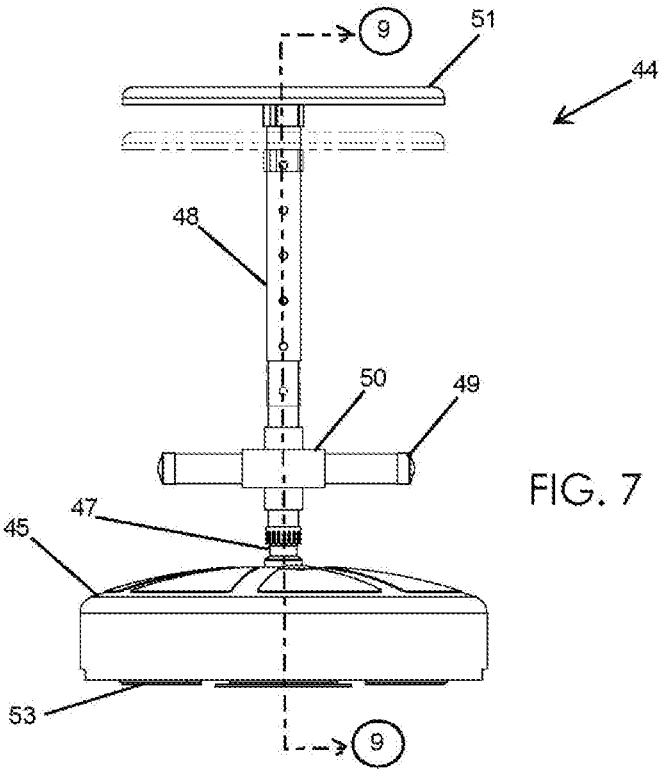
FIG. 7 is a front elevational view of the seat shown in FIG. 1, wherein the seat cushion is vertically reciprocated.
Figure 8:
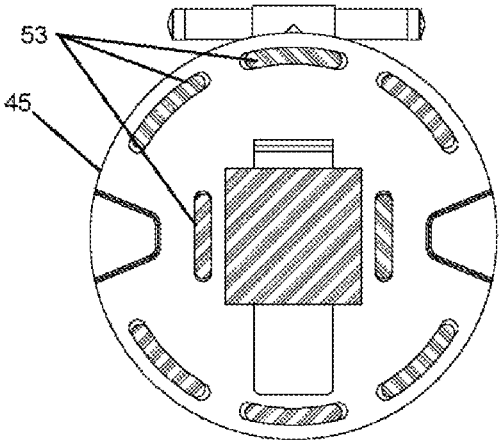
FIG. 8 is a bottom plan view of a seat base of the seat shown in FIG. 6.
Figure 9:
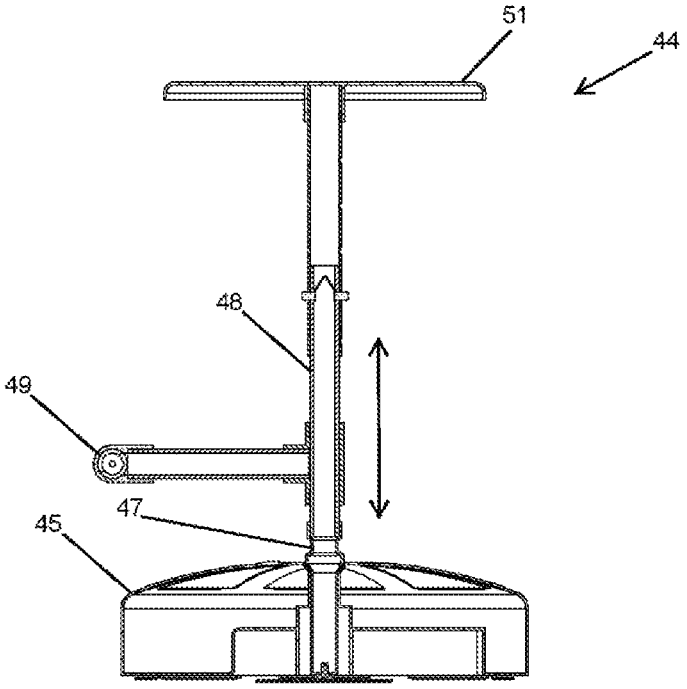
FIG. 9 is a cross-sectional view of the seat taken along line 9-9 in FIG. 7.
Figure 10:
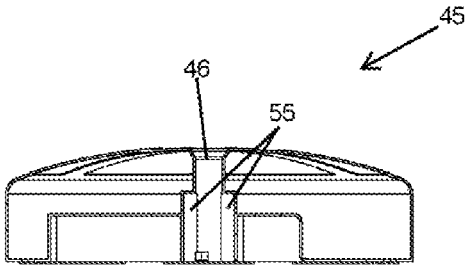
FIG. 10 is a cross-sectional view of the seat base taken along line 9-9 shown in FIG. 7.
Figure 11:
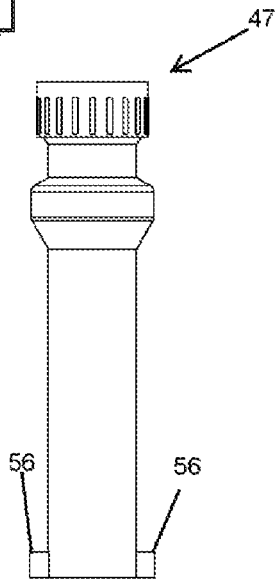
FIG. 11 is an enlarged front elevational view of a seat base connector of the seat shown in FIG. 12.
Figure 12:
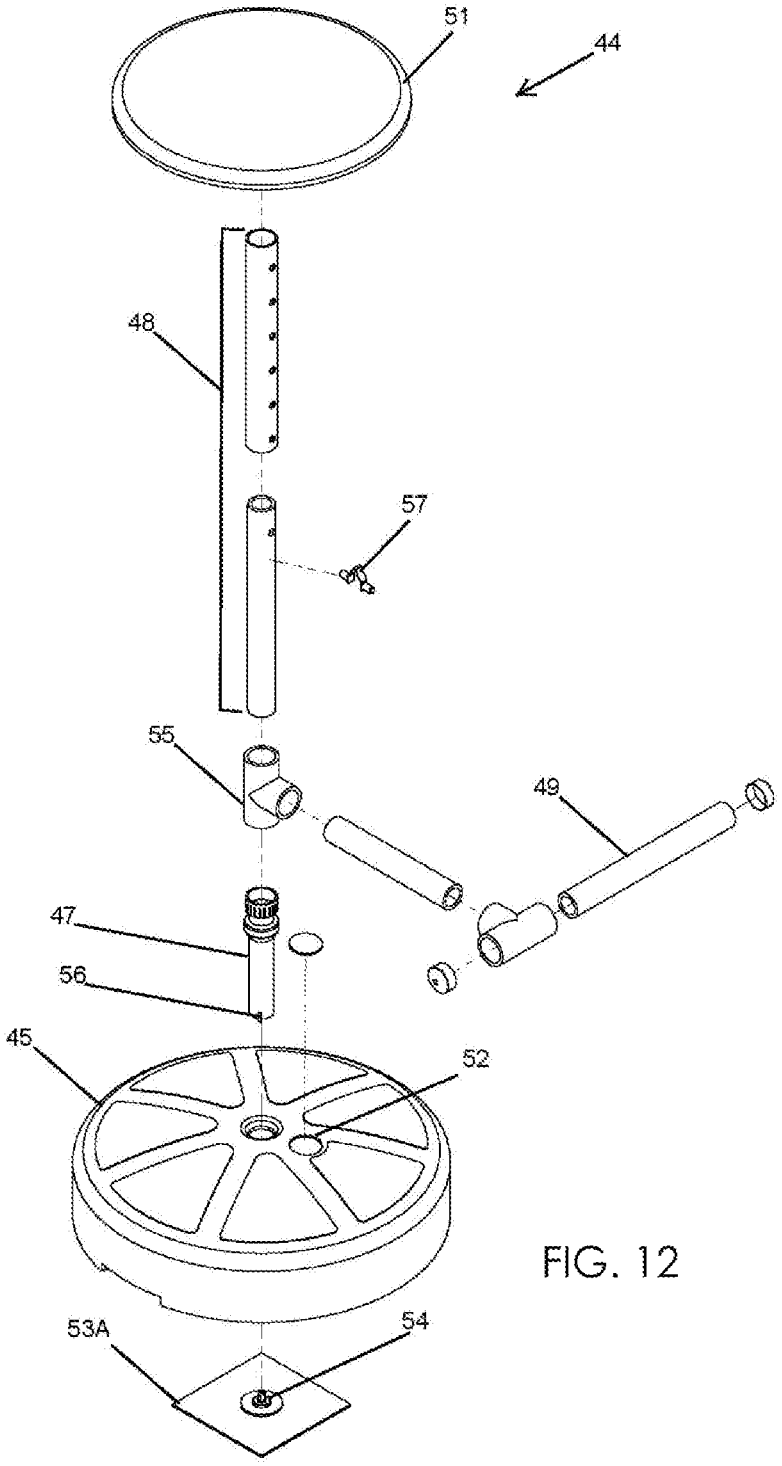
FIG. 12 is an exploded view of the seat shown in FIG. 6.
Figure 13:
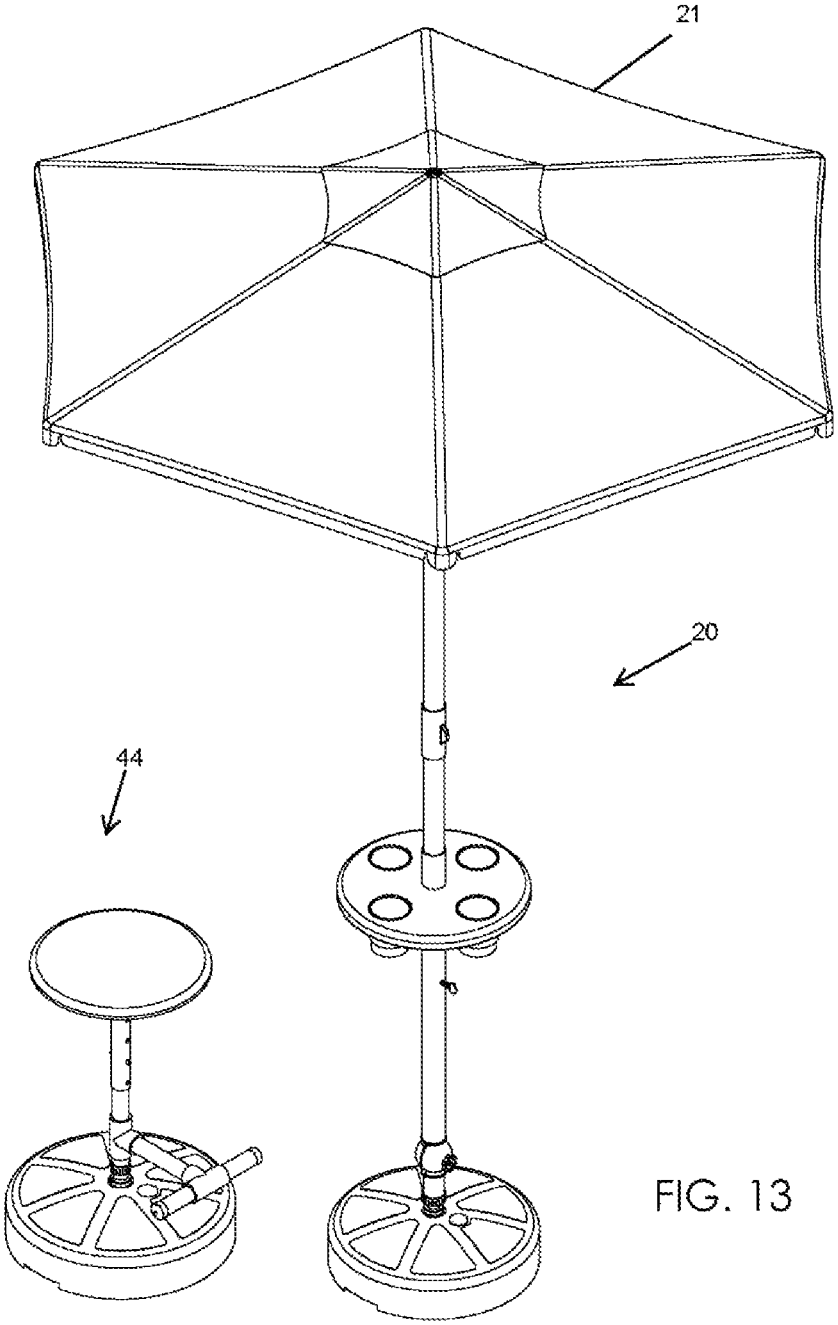
FIG. 13 is a perspective view showing a combination of the umbrella support structure and seat, in accordance with a non-limiting exemplary embodiment of the present disclosure.

The non-limiting exemplary embodiment(s) are referred to generally in FIGS. 1-13 and are intended to provide a selectively adjustable umbrella support structure 20 for providing user enjoyment within a pool. The support structure 20 includes an umbrella 21 having at least one extension pole 22 provided with a centrally registered longitudinal axis 23, and a base 24 capable of being positioned on a bottom surface of a pool wherein the base 24 has a substantially central through-hole 25 axially aligned with the centrally registered longitudinal axis 23. An umbrella base connector 26 is seated within the through-hole 25 and extended vertically upward from the base 24 along the centrally registered longitudinal axis 23. An articulating mechanism 27 is adjustably coupled to the at least one extension pole 22 of the umbrella 21 and to the umbrella base connector 26. Such an articulating mechanism 27 includes a first connector 28 having a hollow tubular top end 29 attached to the at least one extension pole 22 of the umbrella 21, and further has a first adjustable portion 30 opposed from the hollow tubular top end 29. A second connector 31 has a hollow tubular bottom end 32 attached to the umbrella base connector 26, and further has a second adjustable portion 33 opposed from the hollow tubular bottom end 32. Advantageously, the first adjustable portion 30 is rotatably affixed to the second adjustable portion 33 such that the umbrella 21 and the at least one extension pole 22 of the umbrella 21 are selectively articulated relative to a stationary position of the base 24 and about a fulcrum axis 34 registered orthogonal to the centrally registered longitudinal axis 23. Such a structural configuration provides the new, useful, and unexpected result of facilitating user enjoyment while drinking beverages in a pool environment by selectively rotating the umbrella 21 to a desired tilt angle relative to a vertically upright position for providing shade during extends hours.

In a non-limiting exemplary embodiment, the articulating mechanism 27 includes a washer 35 intermediately seated between the first adjustable portion 30 and the second adjustable portion 33. A first fastener 36 is passed through the first adjustable portion 30, the second adjustable portion 33, and the washer 35. A knob 37 is in threaded engagement with the first fastener 36 for selectively adjusting a tilt angle of the first adjustable portion 30 relative to the second adjustable portion 33. Such a structural configuration provides the new, useful, and unexpected result of facilitating controlled articulation of the umbrella 21 with respect to the umbrella base connector 26 and the base 24.

In a non-limiting exemplary embodiment, the at least one extension pole 22 includes a first pole 22A, and a second pole 22B in a telescopic engagement with the first pole 22A, and a second fastener 38 configured to selectively lock the first pole 22A to the second pole 22B. Such a structural configuration provides the new, useful, and unexpected result of varying the height of the umbrella 21 depending upon the heights of the users. For example, the height may be set to minimum for children, and the height may be set at maximum for adults.

In a non-limiting exemplary embodiment, the support structure 20 further includes a third fastener 39, and a cup holder tray 40 linearly reciprocated along at least one of the first pole 22A and the second pole 22B and secured thereto via the third fastener 39. Advantageously, the cup holder tray 40 is displaced along the centrally registered longitudinal axis 23 and remains positioned above the base 24. Such a structural configuration provides the new, useful, and unexpected result of selectively securing the cup holder tray 40 to the first 22A or the second 22B pole depending on the height of the users as well as the depth of the water in the pool, thereby ensuring that a beverage container is adequately held within the cup holder tray 40 above the water surface.

In a non-limiting exemplary embodiment, the base 24 has a hollow configuration and an opening 41 in fluid communication therewith for receiving and housing a ballast material therein. Such a structural configuration provides the new, useful, and unexpected result of providing an optimal weight to the base 24 that is required for underwater stability. The ballast material is preferably a weighted material such as sand, concrete, etc. for anchoring the base 24 at a bottom surface of the pool. It may also be a buoyant material (e.g., foam, etc.) for suspending the support structure 10 at a buoyant state above the bottom surface of the pool.

In a non-limiting exemplary embodiment, the support structure 20 further includes a plurality of umbrella gripper pads 42 attached to and juxtaposed at an exterior bottom surface of the base 24. Advantageously, at least one umbrella gripper pad 42A from the plurality of umbrella gripper pads 42 has a first protrusion 43 (rectilinear alignment pin) extended upwardly through the through-hole 25 along the centrally registered longitudinal axis 23. The through-hole 25 is suitably sized and shaped for succinctly receiving the alignment pin therein for ensuring vertical stability of umbrella base connector 46. Thus, a diameter of the through-hole 25 is slightly larger than a diameter of the alignment pin (first protrusion 43). In this manner, the first protrusion 43 is detachably connected to the umbrella base connector 26. Such a structural configuration provides the new, useful, and unexpected result of ensuring the ballast material does not undesirably leak from the base 24 thereby facilitating secure placement of the support structure underwater.

In a non-limiting exemplary embodiment, the support structure 20 further includes an array of LEDs 58 operatively configured at a bottom surface of the cup holder tray 40 and along a periphery of the cup holder tray 40. The array of LEDs 58 is controllable via an LED controller 59. A power source may be housed at the controller 59. Of course, the controller 59 may be equipped with a transceiver for wirelessly communication with a remote user interface via RF, infrared, BLUETOOTH® signal protocols. Such a structural configuration provides the new, useful, and unexpected result of illuminating the bottom surface of the cup holder tray 40, thereby providing an aesthetically pleasing appearance to the cup holder tray 40, especially in a post sunset environment or in an environment with dim lighting.

In a non-limiting exemplary embodiment, the support structure 20 further includes a portable seat 44 for receiving a user buttock thereon. Such a seat 44 is located adjacent to the umbrella 21 and includes a seat base 45 capable of being positioned on a bottom surface of a pool or buoyantly displaced within the pool. The seat base 45 has an axial bore 46. A seat base connector 47 is linearly inserted within the axial bore 46, and an anchor pole 48 is attached to the seat base connector 47. Notably, the anchor pole 48 has a telescopic configuration, wherein the height of the anchor pole 48 is varied via a fourth fastener 57. A leg rest 49 is also provided. A three-way coupling 50 is attached to the anchor pole 48 and the leg rest 49 to facilitate linear reciprocation of the leg rest 49 with respect to the anchor pole 48. A seat cushion 51 is fitted at a top end of the anchor pole 48. Such a structural configuration provides the new, useful, and unexpected result of providing the user with an option to support their buttocks on a seat while enjoying a beverage in the pool.

In a non-limiting exemplary embodiment, the seat base 45 has a hollow configuration and an opening 52 for receiving in a ballast material therein. Such a structural configuration provides the new, useful, and unexpected result of providing an optimal weight to the seat base that is required for underwater stability. The ballast material is preferably a weighted material such as sand, concrete, etc. for anchoring the seat base 45 at a bottom surface of the pool. It may also be a buoyant material (e.g., foam, etc.) for suspending the portable seat 44 at a buoyant state above the bottom surface of the pool.

In a non-limiting exemplary embodiment, the support structure 20 further includes a plurality of seat base gripper pads 53 attached to and juxtaposed at an exterior bottom surface of the seat base 45. Advantageously, at least one seat base gripper pad 53A has a second protrusion 54 connected with the seat base connector 47. The second protrusion 54 (rectilinear second alignment pin) extends upwardly through the axial bore 46 along a centrally registered longitudinal axis of the seat base 45. The axial bore 46 is suitably sized and shaped for succinctly receiving the second alignment pin therein for ensuring vertical stability of seat base connector 47. Thus, a diameter of the axial bore 46 is slightly larger than a diameter of the second alignment pin (second protrusion 54). Such a structural configuration provides the new, useful, and unexpected result of ensuring the ballast material does not undesirably leak from the seat base 45 thereby facilitating secure placement of the support structure underwater.

In a non-limiting exemplary embodiment, a pair of diametrically opposed slots 55 are located within the axial bore 46. Advantageously, the seat base connector 47 has a pair of diametrically opposed fingers 56 statically affixed thereto. Such fingers are linearly and slidably inserted into the opposed slots 55 for receiving and locking the seat base connector 47 to the seat base 45. Such a structural configuration provides the new, useful, and unexpected result of locking the movement the seat base connector 47 and the anchor pole 48 to the seat base 45 underwater.

In a non-limiting exemplary embodiment, the three-way coupling is directly affixed 50 to the leg rest 49 and the anchor pole 48. Such a structural configuration provides the new, useful, and unexpected result of facilitating the variation in the height of the leg rest depending the height of the user seated on the seat.

The present disclosure further includes a support structure 20 for providing user enjoyment within a pool. The support structure 20 includes a portable umbrella 21 having at least one extension pole 22 provided with a centrally registered longitudinal axis 23, a portable base 24 capable of being positioned on a bottom surface of a pool wherein the base 24 has a substantially central through-hole 25 axially aligned with the centrally registered longitudinal axis 23, an umbrella base connector 26 seated within the through-hole 25 and extended vertically upward from the base 24 along the centrally registered longitudinal axis 23, and an articulating mechanism 27 adjustably coupled to the at least one extension pole 22 of the umbrella 21 and to the umbrella base connector 26. Advantageously, the articulating mechanism 27 includes a first connector 28 having a hollow tubular top end 29 attached to the at least one extension pole 22 of the umbrella 21, and further has a first adjustable portion 30 opposed from the hollow tubular top end 29. The articulating mechanism 27 further includes a second connector 31 having a hollow tubular bottom end 32 attached to the umbrella base connector 26, and further has a second adjustable portion 33 opposed from the hollow tubular bottom end 32. Advantageously, the first adjustable portion 30 is rotatably affixed to the second adjustable portion 33 such that the umbrella 21 and the at least one extension pole 22 of the umbrella 21 are selectively articulated relative to a stationary position of the base 24 and about a fulcrum axis 34 registered orthogonal to the centrally registered longitudinal axis 23. Such a structural configuration provides the new, useful, and unexpected result of facilitating user enjoyment while drinking beverages in a pool environment by selectively rotating the umbrella 21 to a desired tilt angle relative to a vertically upright position for providing shade during extends hours.

The present disclosure further includes a method of utilizing a support structure 20 for providing user enjoyment within a pool. Such a method includes the steps of: accessing a pool; providing a portable umbrella 21 having at least one extension pole 22 equipped with a centrally registered longitudinal axis 23; providing and positioning a portable base 24 on a bottom surface of the pool, wherein the base 24 has a substantially central through-hole 25 axially aligned with the centrally registered longitudinal axis 23; providing and seating an umbrella base connector 26 within the through-hole 25 and extending the umbrella base connector 26 vertically upward from the base 24 along the centrally registered longitudinal axis 23; and providing and adjustably coupling an articulating mechanism 27 to the at least one extension pole 22 of the umbrella 21 and to the umbrella base connector 26. Such an articulating mechanism 27 includes a first connector 28 having a hollow tubular top end 29 attached to the at least one extension pole 22 of the umbrella 21, and further has a first adjustable portion 30 opposed from the hollow tubular top end 29. The articulating mechanism 27 further includes a second connector 31 having a hollow tubular bottom end 32 attached to the umbrella base connector 26, and further having a second adjustable portion 33 opposed from the hollow tubular bottom end 32. Such a combination of method steps provide the new, useful, and unexpected result of allowing the user to consume their favorite beverage while also enjoying in the pool.

The method further includes the step of: rotatably affixing the first adjustable portion 30 to the second adjustable portion 33 such that the umbrella 21 and the at least one extension pole 22 of the umbrella 21 are selectively articulated relative to a stationary position of the base 24 and about a fulcrum axis 34 registered orthogonal to the centrally registered longitudinal axis 23. Such a combination of method steps provide the new, useful, and unexpected result of facilitating controlled articulation of the umbrella with respect to the umbrella base connector and the base. Thus, the user can drink beverages in a pool environment while selectively rotating the umbrella 21 to a desired tilt angle relative to a vertically upright position for providing shade during extends hours.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A support structure for providing user enjoyment within a pool, the support structure comprising:

an umbrella having at least one extension pole provided with a centrally registered longitudinal axis;

a base capable of being positioned on a bottom surface of a pool, the base having a substantially central through-hole axially aligned with the centrally registered longitudinal axis;

an umbrella base connector seated within the through-hole and extended vertically upward from the base along the centrally registered longitudinal axis;

an articulating mechanism adjustably coupled to the at least one extension pole of the umbrella and to the umbrella base connector, the articulating mechanism comprising a first connector having a hollow tubular top end attached to the at least one extension pole of the umbrella, and further having a first adjustable portion opposed from the hollow tubular top end, and a second connector having a hollow tubular bottom end attached to the umbrella base connector, and further having a second adjustable portion opposed from the hollow tubular bottom end;

wherein the first adjustable portion is rotatably affixed to the second adjustable portion such that the umbrella and the at least one extension pole of the umbrella are selectively articulated relative to a stationary position of the base and about a fulcrum axis registered orthogonal to the centrally registered longitudinal axis;

a seat for receiving a user buttock thereon, said seat being located adjacent to the umbrella and comprising a seat base capable of being positioned on a bottom surface of a pool, said seat base having an axial bore, a seat base connector linearly inserted within the axial bore, an anchor pole attached to the seat base connector, the anchor pole having a telescopic configuration, a leg rest, a three-way coupling attached to the anchor pole and the leg rest to facilitate linear reciprocation of the leg rest with respect to the anchor pole, and a seat cushion fitted at a top end of the anchor pole.

2. The support structure according to claim 1, wherein the articulating mechanism comprises:

a washer intermediately seated between the first adjustable portion and the second adjustable portion;

a first fastener passed through the first adjustable portion, the second adjustable portion, and the washer; and a knob in threaded engagement with the fastener for selectively adjusting a tilt angle of the first adjustable portion relative to the second adjustable portion.

3. The support structure according to claim 2, wherein the at least one extension pole comprises:

a first pole and a second pole in a telescopic engagement with the first pole; and a second fastener configured to selectively lock the first pole to the second pole.

4. The support structure according to claim 3, further comprising:

a third fastener; and a cup holder tray linearly reciprocated along at least one of the first pole and the second pole and secured thereto via the third fastener;

wherein the cup holder is displaced along the centrally registered longitudinal axis and remains positioned above the base.

5. The support structure according to claim 4, wherein the base has a hollow configuration and an opening in fluid communication therewith for receiving and housing a ballast material therein.

6. The support structure according to claim 5, further comprising: a plurality of umbrella gripper pads attached to and juxtaposed at a bottom surface of the base, wherein at least one umbrella gripper pad from the plurality of umbrella gripper pads has a first protrusion extended upwardly through the opening along the centrally registered longitudinal axis, said first protrusion being detachably connected to the umbrella base connector.

7. The support structure according to claim 1, wherein the seat base has a hollow configuration and an opening for receiving in a ballast material therein.

8. The support structure according to claim 1, further comprising: a plurality of seat base gripper pads attached to and juxtaposed at a bottom surface of the seat base, wherein at least one seat base gripper pad has a second protrusion connected with the seat base connector.

9. The support structure according to claim 1, wherein a pair of diametrically opposed slots are located within the axial bore; wherein said seat base connector has a pair of diametrically opposed fingers statically affixed thereto, said fingers being linearly and slidably inserted into the opposed slots for receiving and locking said seat base connector to said seat base.

10. The support structure according to claim 1, wherein said three-way coupling is directly affixed to said leg rest and said anchor pole.

11. A support structure for providing user enjoyment within a pool, the support structure comprising:

a portable umbrella having at least one extension pole provided with a centrally registered longitudinal axis;

a portable base capable of being positioned on a bottom surface of a pool, the base having a substantially central through-hole axially aligned with the centrally registered longitudinal axis;

an umbrella base connector seated within the through-hole and extended vertically upward from the base along the centrally registered longitudinal axis;

an articulating mechanism adjustably coupled to the at least one extension pole of the umbrella and to the umbrella base connector;

a seat for receiving a user buttock thereon, said seat being located adjacent to the umbrella and comprising a seat base capable of being positioned on a bottom surface of a pool, said seat base having an axial bore, a seat base connector linearly inserted within the axial bore, an anchor pole attached to the seat base connector, the anchor pole having a telescopic configuration, a leg rest, a three-way coupling attached to the anchor pole and the leg rest to facilitate linear reciprocation of the leg rest with respect to the anchor pole, and a seat cushion fitted at a top end of the anchor pole.

* * * * *